US005560121A

United States Patent [19]

Fertig et al.

[11] Patent Number: 5,560,121

[45] Date of Patent: Oct. 1, 1996

[54] ENERGY-EFFICIENT PROCESS FOR TREATING AN OBJECT WITH A HOT AIR FLOW AND HAND-HELD DEVICE FOR PERFORMING SAID PROCESS

[75] Inventors: Werner Fertig, Bensheim; Robert Schramm, Oberursel; Frank Seja, Reinheim, all of Germany

[73] Assignee: Wella Aktiengesellschaft, Darmstadt, Germany

[21] Appl. No.: 325,352

[22] PCT Filed: Mar. 2, 1994

[86] PCT No.: PCT/EP94/00610

§ 371 Date: Oct. 21, 1994

§ 102(e) Date: Oct. 21, 1994

[87] PCT Pub. No.: WO94/19982

PCT Pub. Date: Sep. 15, 1994

[30] Foreign Application Priority Data

Mar. 2, 1993 [DE] Germany ..... 43 06 429.9

[51] Int. Cl.[6] ..... F26B 19/00

[52] U.S. Cl. ..... 34/90; 34/97

[58] Field of Search ..... 34/90, 96, 97, 34/98, 99, 283

[56] References Cited

U.S. PATENT DOCUMENTS 5,231,770 8/1993 Fertig ..... 34/96

5,438,763 8/1995 Yang ..... 34/97

*Primary Examiner*—John T. Kwon

*Attorney, Agent, or Firm*—Michael J. Striker

[57] ABSTRACT

The energy-efficient hand-held device for treating an object with a flow of hot air includes a handle for positioning it in relation to the object, a blower for producing an air flow; a heating device for heating the air flow from the blower; a sensor device for determining when an interruption in the treating of the object with the hot air is or is not occurring; and a device for turning off or turning on the heating device and, if desired, the blower in response to a signal from the sensor device. The sensor device can be a light or ultrasonic transmitter and receiver which detects the presence or absence of reflected light or ultrasonic waves from the object and measures the distance to the object to determine if it is greater than or less than a threshold distance (S). Other embodiments are described.

26 Claims, 11 Drawing Sheets

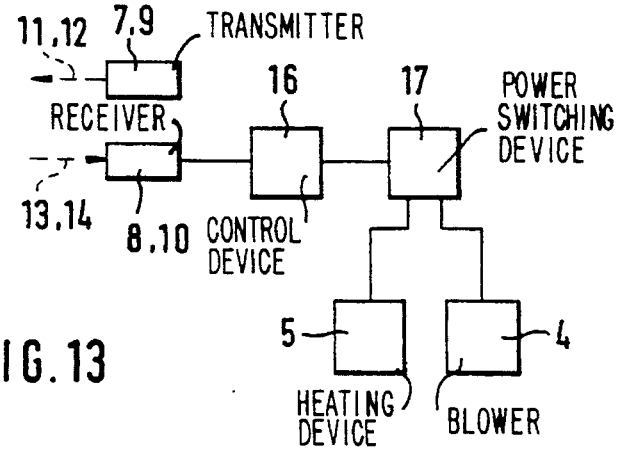
FIG. 13
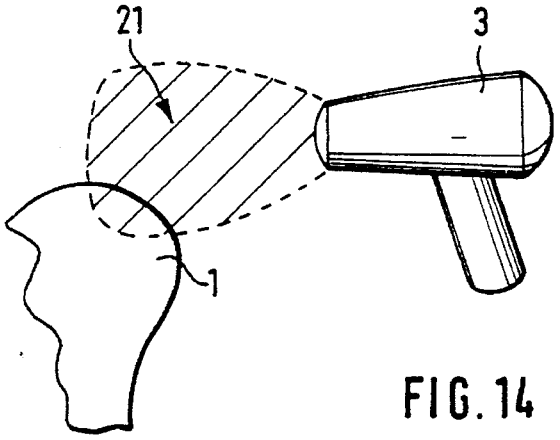
FIG. 14
FIG. 15a
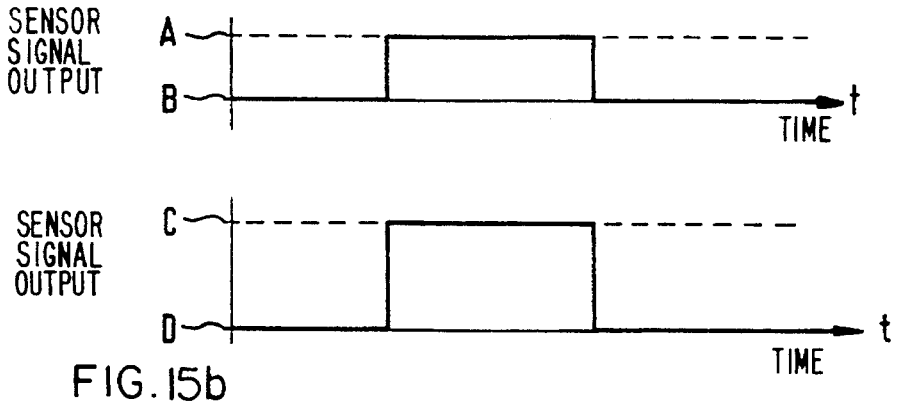
FIG. 15b

FIG.27a
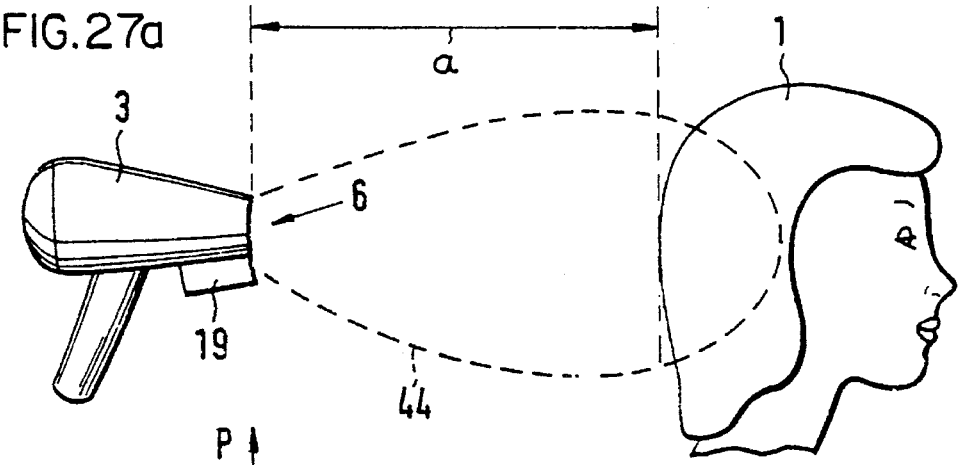
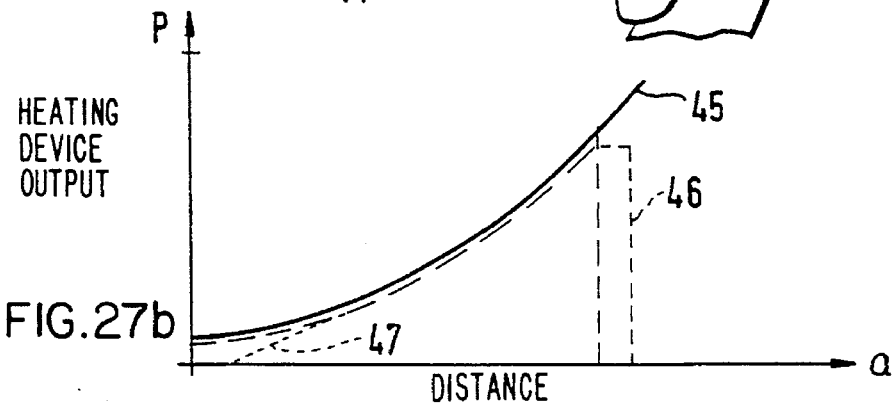
FIG.27b
FIG.28a
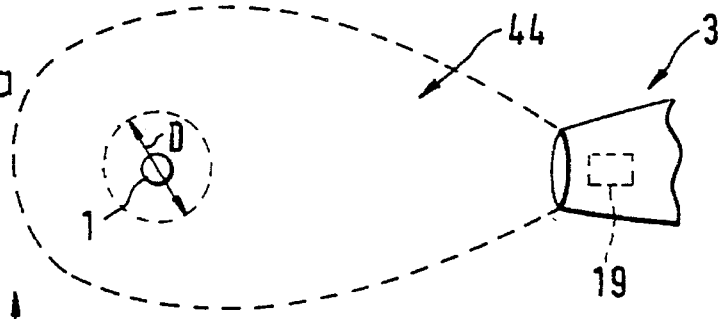
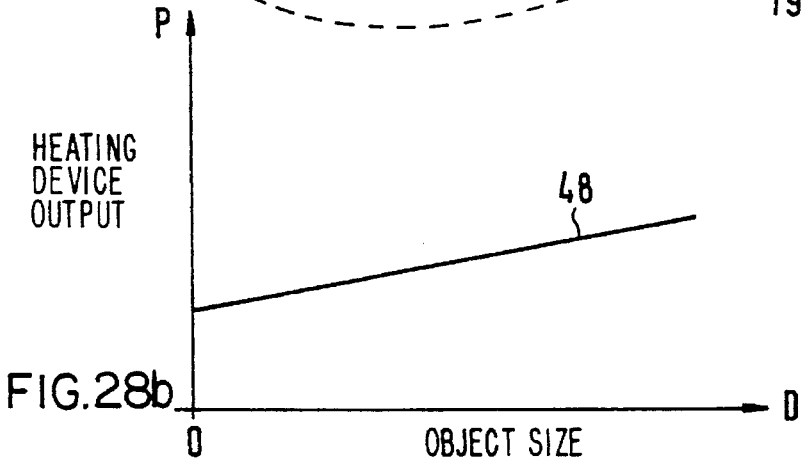
FIG.28b

ENERGY-EFFICIENT PROCESS FOR TREATING AN OBJECT WITH A HOT AIR FLOW AND HAND-HELD DEVICE FOR PERFORMING SAID PROCESS

BACKGROUND OF THE INVENTION

The invention relates to an energy-efficient process for treating an object with hot air by directing hot air on the object from a hand-held device and to a hand-held device for performing that process.

Hand-held devices for directing a hot air flow on the object are known, e.g., as hand-held hair driers or hot air blowers. In particular, hairdressers working professionally with this type of hand-held device for treating a customer's hair with a flow of hot air must repeatedly interrupt the hot air flow treatment, for example, to comb the hair, install and remove curlers, or to part or arrange hair. In particular during brief interruptions in treatment the hand-held device continues to run—for reasons of convenience—with the heat output set to approximately 500 to 1500 watts so that the hot air flows uselessly past the hair. In order to make better use of energy, it would be necessary to switch the hand-held devices on and off manually which is very cumbersome in practice and is therefore not done.

SUMMARY OF THE INVENTION

It is an object of the present invention to provide a process for treating an object with hot air by directing hot air on the object from a hand-held heating device which conserves energy in a convenient manner during interruptions in the treatment.

It is another object of the present invention to provide a hand-held device for producing a hot air flow to be directed on an object which conserves energy in a convenient manner during interruptions in treatment.

According to the invention, the process for treating an object with a flow of hot air produced by the hand-held device of the above-described type having a blower generating an air flow and a heating device for heating the air flow generated by the blower, includes the steps of:

a) automatically at least reducing a heat output of the heating device from a predetermined heat output value when an interruption in the treating of the object with the hot air is occurring; and b) automatically restoring the heat output of the hand-held device to the predetermined heat output value when the interruption in the treating is not occurring.

In a preferred embodiment of the process according to the invention the blower is switched off when the automatically at least reducing the heat output of the heating device occurs and switched on when the automatically restoring the heat output of the hand-held device occurs or is completed.

In another preferred embodiment of the process according to the invention the automatically at least reducing the heat output consists of turning off the heating device.

According to the invention an "interruption" in the treating of the object occurs when the flow of the hot air does not reach the object to be heated and/or a distance between the hand-held device and the object to be heated exceeds a predetermined threshold spacing. The process of the invention thus determines whether or not an interruption is occurring or not by determining if the flow of the hot air is not reaching the object to be treated and/or if the distance between the hand-held device and the object to be treated exceeds a predetermined threshold spacing.

The hand-held device according to the invention for treating an object with a flow of hot air comprises a blower for producing an air flow; a heating device for heating the flow of air from the blower to make a hot air flow; means for automatically at least reducing a heat output of the heating device from a predetermined heat output value when an interruption in the treating of the object with the hot air is occurring; and means for automatically restoring the heat output of the hand-held device to the predetermined heat output value when the interruption in the treating is not occurring.

In a preferred embodiment of the invention a connecting switch is provided electrically connecting the blower and the heating device and an on-off switch is connected between the connecting switch and the blower.

The hand-held device according to the invention advantageously includes means for detecting that the flow of the hot air does not reach the object. This means for detecting can comprise a light transmitter having means for propagating light in a direction of the hot air flow from the blower and a light receiver including means for receiving light reflected from the object and producing an output signal depending on the light reflected from the object. Alternatively it can include sensor means comprising ultrasonic transmitter means for propagating an ultrasonic signal in a direction of the hot air flow from the blower and ultrasonic receiver means for receiving a reflected ultrasonic signal from the object. The ultrasonic transmitter means and the ultrasonic receiver means can include a single common ultrasonic transducer operated alternately as an ultrasonic pulse transmitting device and an ultrasonic pulse receiving device. However separate transducers can be used in the transmitter means and receiver means.

The hand-held device can also advantageously or alternatively include means for detecting that a distance between the hand-held device and the object to be heated exceeds a threshold spacing. The means for detecting that the distance between the hand-held device and the object exceeds the threshold spacing comprises a sensor for measuring distance. The sensor advantageously includes ultrasonic transmitter means for propagating an ultrasonic signal in a direction of the hot air flow from the blower and ultrasonic receiver means for receiving a reflected ultrasonic signal from the object. In a manner similar to the above embodiment either a single common transducer which operates alternatively as part of the transmitter means and receiver means can be provided or separate transducers can be provided in the transmitter means and receiver means which is spaced from the transmitter means. The transmitter means and receiver means can be located in either the handle or the nozzle of the device.

In another advantageous embodiment the sensor for measuring distance between the object and the hand-held device is an air pressure sensor.

The hand-held device also advantageously includes means for delaying the reduction or shut off of the heating output which is associated with the means for automatically at least reducing the heating output. This delaying means provides a delay time of from 0.5 to 4 seconds between the time the interruption starts and the reducing or shutting off of the heat output from the heating device.

In another preferred embodiment of the invention the means for automatically at least reducing the heat output includes means for maintaining an air temperature of the hot air flow on the object constant when the hot air flow reaches the object.

In another embodiment the means for automatically at least reducing the heat output includes means for lowering an air temperature of the hot air flow on the object in proportion to a distance from the object.

Advantageously the predetermined heating output value is proportional to a size of the object being treated.

BRIEF DESCRIPTION OF THE DRAWING

The objects, features and advantages of the present invention will now be illustrated in more detail by the following detailed description, reference being made to the accompanying drawing in which:

FIG. 13 shows a block diagram of the embodiment of the process of FIG. 12;

FIG. 14 is a diagrammatic side view of an ultrasonic field of a device for detecting an object to be heated according to the method of the invention;

FIG. 15 is a graphical illustration of electronic signals received during detection of the object shown in FIG. 14;

FIG. 27 shows a distance-independent regulating process for maintaining a constant temperature of a flow of hot air on an object;

FIG. 28 is a graphical illustration of the dependence of a heating output P on distance of the hand-held device from the object to be heated in the method illustrated in FIG. 27;

FIG. 29 shows a regulating process for conditioning hair in which the heating output of the hand-held device depends on the size of the object; and FIG. 30 is a graphical illustration of the dependence of heating output of the hand-held device on size of the object to be heated.

DESCRIPTION OF THE PREFERRED EMBODIMENTS

Figure 1:
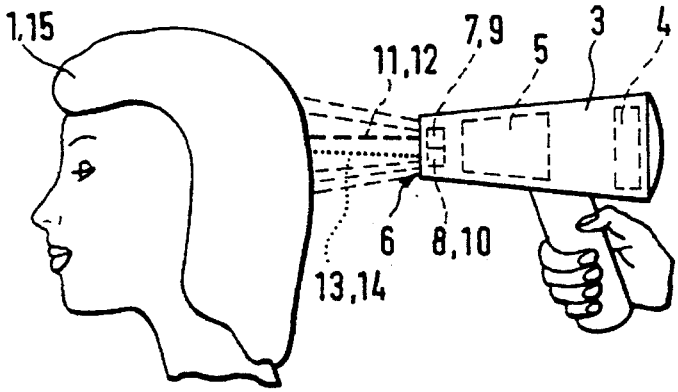
FIGS. 1 to 5 show a plurality of process steps for treatment of an object with a flow of hot air using a hand-held device.
Figure 2:
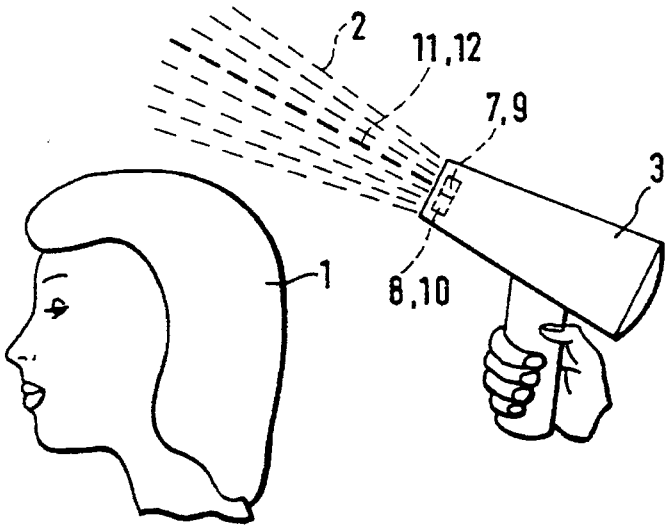
Figure 3:
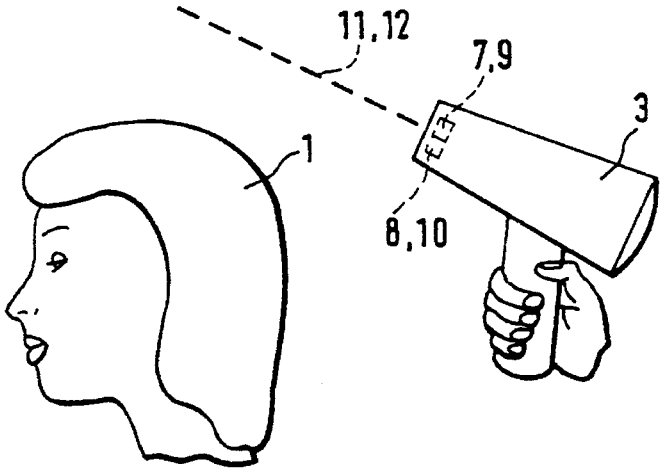
Figure 4:
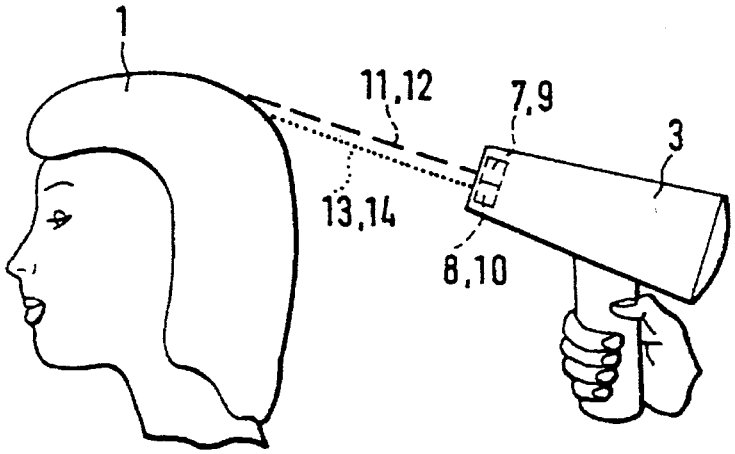

FIGS. 1 to 5 show the process steps of a first embodiment of a process for treating an object 1 with a hot air flow 2 according to the invention. In FIG. 1 the hot air flow 2 is directed to the object 1 by a hand-held device 3 comprising a blower 4 and a heating device 5. The hand-held device 3 also has a handle H so that it can be held at an arbitrary distance from the object 1 or pointed in any direction. FIG. 1 shows the switched-on device 3 with the heating device 5 producing a predetermined heating output. The hot air flow 2 is directed on the object 1, e.g., the hair of a hair dressing customer, for treating this object 1. An ultrasonic transmitter 7 and an ultrasonic receiver 8 or a light transmitter 9 and a light receiver 10 are arranged on the hand-held device 3 near the air flow outlet opening 6. An ultrasonic field 11 or a light beam 12 is radiated by the transmitter 7,9 to detect the object 1. By detecting a reflected ultrasonic field 13 or a reflected light beam 14 with the receiver 8,10 it may be determined whether or not the hot air flow 2 strikes the object 1. If the hot air flow 2 does not strike the object 1 as shown in FIG. 2, there is no reflected sonic field 13 or reflected light 14 and a signal is generated for switching off the heating device 5. If the hot air flow 2 strikes the object 1, a reflected sonic field 13 or reflected light 14 occurs and is converted by the receiver 8,10 into a signal for switching on the heating device 5.

Figure 5:
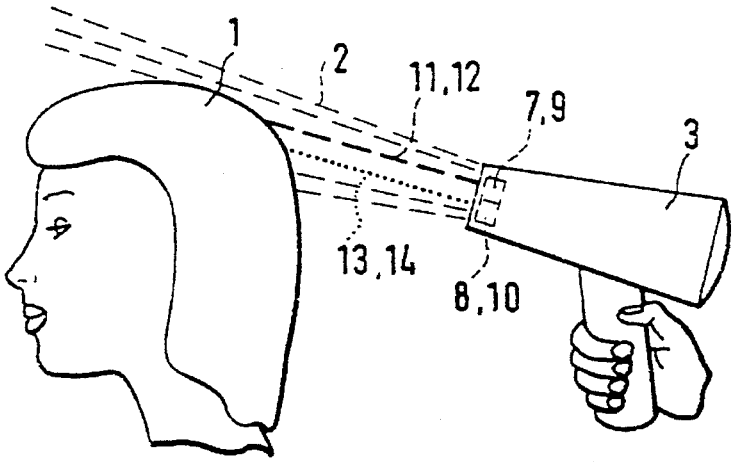

In FIG.2, the hot air flow 2 flows past the object 1, e.g., while the hair 15 is being arranged. Since there is no reflected sonic field 13 or reflected light 4, the heating device 5 and, if desired, the blower 4 are switched off automatically (FIG. 3), while the transmitter 7,9 continues to radiate the ultrasonic field 11 or light 12. If the hand-held device 3 held by handle H is turned in the direction of the object 1 again (FIG. 4), a reflected sonic field 13 or reflected light 14 occurs again and is converted into a suitable signal by the receiver 8,10 to switch on the heating device 5 (and, if desired, blower 4) automatically (FIG. 5). The ultrasonic field 11, 13 and light 12, 14 shown in FIGS. 1 to 5 is only shown schematically for the purpose of illustrating the operation of the invention.

Figure 6:
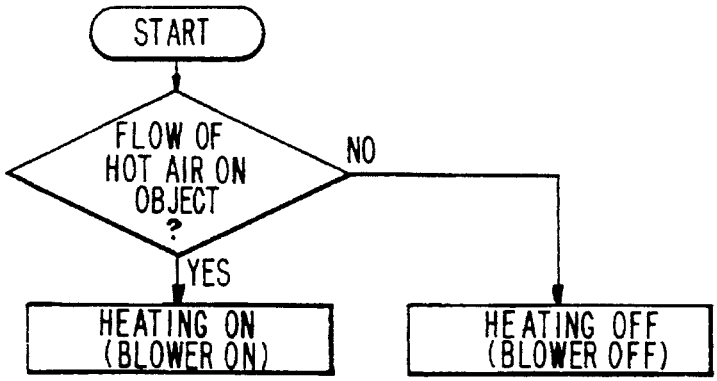
FIG. 6 shows a flow chart of the process shown in FIGS. 1 to 5.

FIG. 6 shows a flow chart corresponding to the process illustrated in FIGS. 1 to 5.

Figure 7:
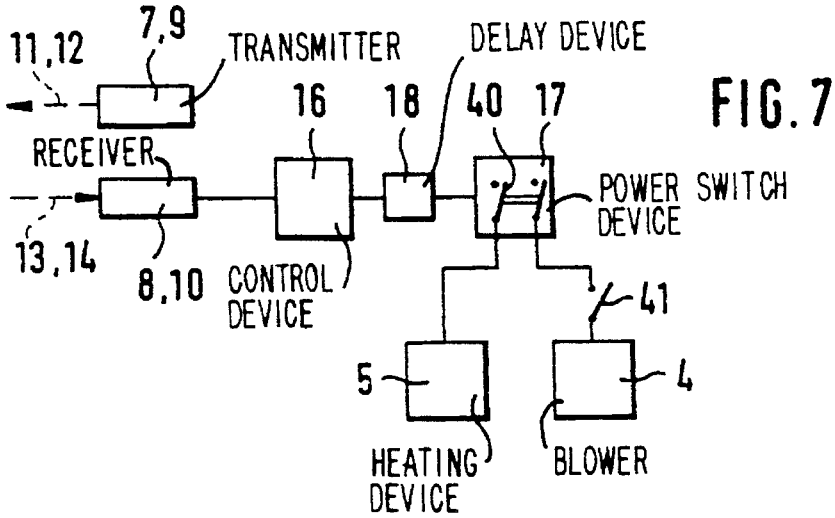
FIG. 7 shows a block diagram of a device for performing the process illustrated in FIGS. 1 to 5.

A corresponding block diagram for one embodiment of a hand-held device 3 for carrying out the process of FIGS. 1 to 5 is shown in FIG. 7. The ultrasonic field 11 or light 12 radiated by the transmitter 7,9 is received by the receiver 8,10 as a reflected ultrasonic field 13 or reflected light 14 reflected by the object 1 and is converted by a connected control signal device 16 into a control signal which is fed to a heater-blower control device 17 including a double relay switch 40 for switching on and switching off the heating device 5 and, when blower automatic control cutout switch 41 is closed, also the blower 4. The advantage in not switching off the blower 4 when the heating device 5 is switched off consists in that the noise level of the device 3 is maintained. Moreover, the power requirement for the blower 4 is only approximately 10% of the power consumed by the device 3. The heating device consumes approximately 90% of it. A switch-off delay device 18 may be provided optionally between the control signal device 16 and the heater-blower control device 17 to avoid short-term switching operations. The delay time can be 0.5 to 4 seconds in practice.

Figure 8:
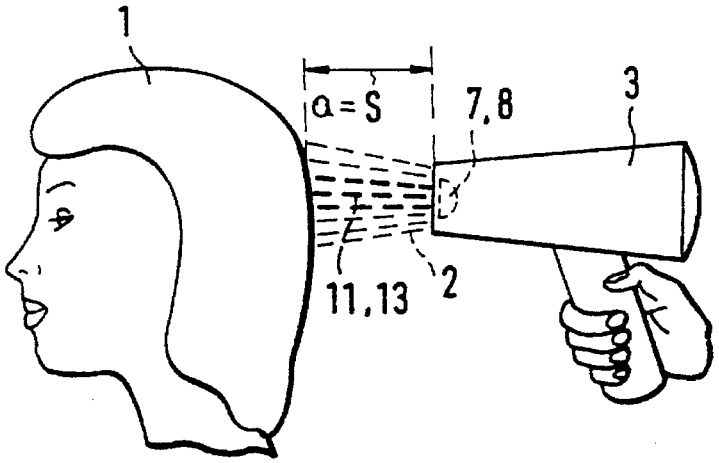
FIGS. 8 and 9 show process steps of another embodiment of the process for the treatment of an object with a flow of hot air using a hand-held device.
Figure 9:
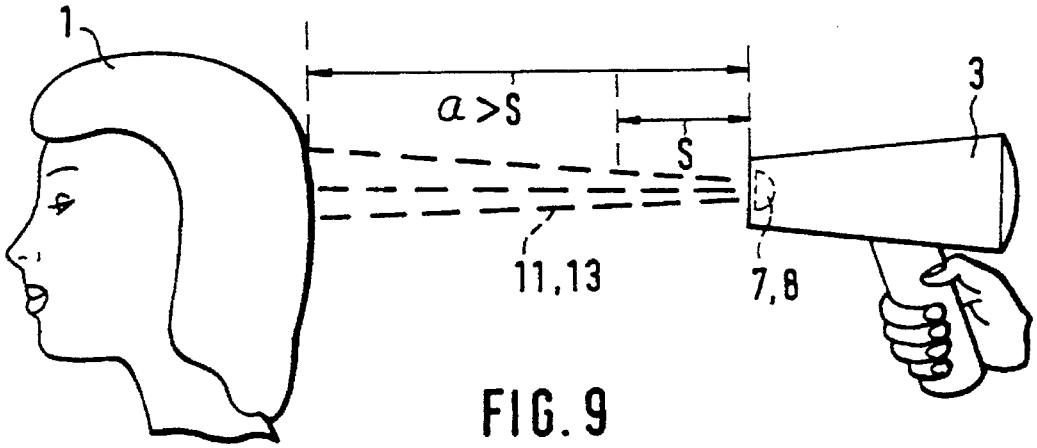

In another embodiment example according to FIGS. 8 and 9, the hand-held device 3 operates in a distance-dependent manner with reference to the object 1. The transit time of the reflected ultrasonic pulses 13 is used as a basis for measuring the distance a to the object 1 according to the principle of ultrasonics. When a given distance a from the object 1 exceeds S (a>S), the heating device 5 and, if desired, the blower 4 switches off—optionally after a delay—automatically (FIG. 9).

Figure 10:
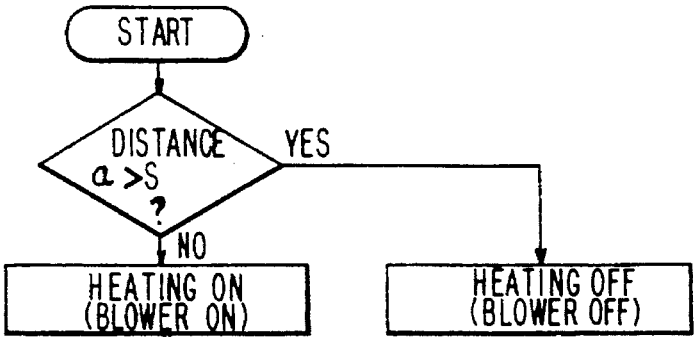
FIG. 10 shows a flow chart of the process shown in FIGS. 8 and 9.

FIG. 10 shows a flow chart corresponding to the process illustrated in FIGS. 8 and 9.

Figure 11:
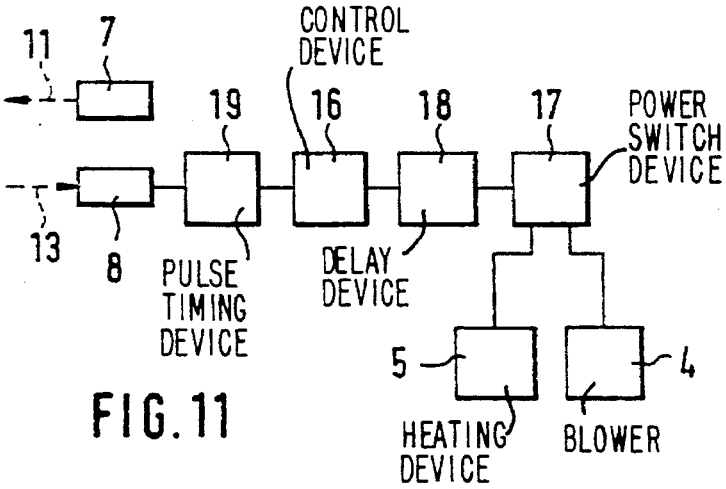
FIG. 11 shows a block diagram of a device for performing the process illustrated in FIGS. 8 and 9.

FIG. 11 shows a corresponding block diagram of a hand-held device for performing the process shown in FIG. 10. The ultrasonic pulses 11 radiated by the ultrasonic transmitter 7 are received by the ultrasonic receiver 8 as reflected ultrasonic pulses 13 and the corresponding transit times of the pulses 11 are determined in a distance measuring device 19 and fed to the control signal device 16 to form control signals. If a predetermined distance S between the object 1 and the hand-held device 3 is not exceeded, a control signal is sent to the power switch device 17 which switches on the heating device 5 and, in some embodiments, the blower 4. However in a preferred embodiment only the heating device 5 is switched on and off by the automatic control means. A switch-off delay device 18 may be provided optionally between the control signal device 16 and the power switch device 17. If the distance a between the outlet 6 of the hand-held device 3 and the object 1 exceeds the threshold distance S (a>S) or the device 3 is pointed away from the object 1 (reflected ultrasonic pulses 13 are not received), the distance measuring device 19 sends an appropriate signal to the control signal device 16 which sends a corresponding off signal to the power switch device 17 which switches off the heating device 5 (and blower 4). When the distance a≦S is reached again, the heating device 5 is switched on again.

Figure 12:
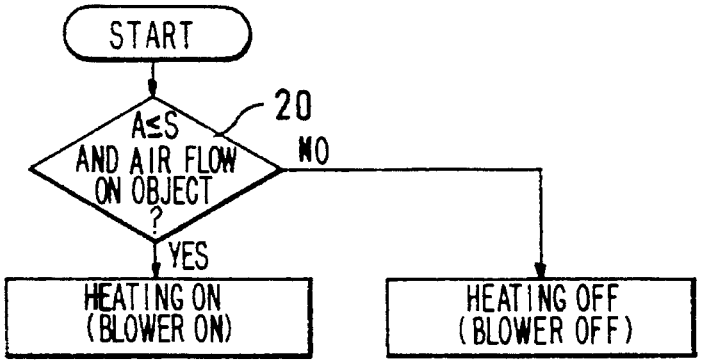
FIG. 12 shows a flow chart of an additional embodiment of the process according to the invention.

FIG. 12 shows a flow chart for another embodiment of the process according to the invention in which the hand-held device 3 is turned on or off automatically according to the results of a test 20. The test result for the test 20 is "yes", if the distance a<S or a hot air flow on object 1 is detected. If the test result is "yes" the heating device 5 is advantageously turned on in a preferred embodiment but in other embodiments the blower 4 may also be turned on. The transit time of sonic pulses can be used to measure distance a to the object 1 and the reflected light principle can be used to detect a hot air flow 2 directed on an object 1.

FIG. 13 shows a block diagram of a hand-held device 3 from performing a process according to the embodiment of FIG. 12. A combined transmitter/receiver 7,9 and 8,10, respectively, for sound and light is provided. The remaining components shown in FIG. 13 are the same as those shown in FIGS. 7 and 11 and perform the same function.

FIG. 14 shows a lobe-shaped ultrasonic field 21 used in the process. When an object 1 contacts this field 21, the heating device 5 remains on. Depending on the dimensions of the diameter of the lobe-shaped field 21, a switch-off delay device 18 may be omitted from the device.

FIG. 15 shows electronic signals generated when a field 21 according to FIG. 14 is contacted by an object 1 (A), or not contacted (B), and the corresponding signals (C), (D).

Figure 16:
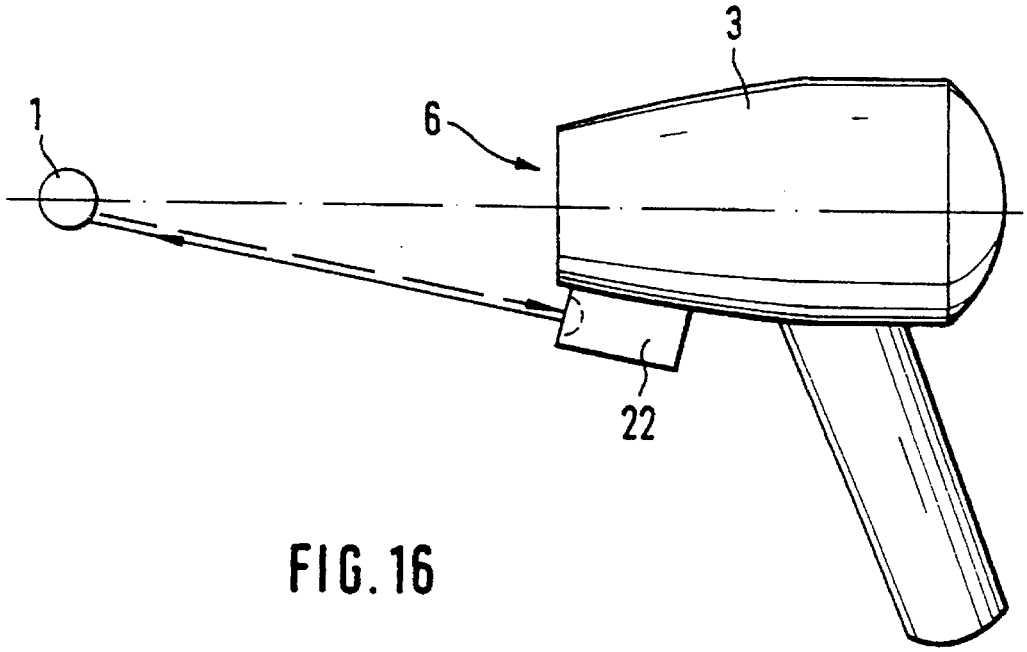
FIG. 16 is a diagrammatic side view of a hand-held device with a switchable ultrasonic transmitter/receiver arranged adjacent to an air-flow outlet opening.

In FIG. 16 a hand-held device 3 according to the invention is shown having an ultrasonic transducer 22 which operates alternately as a transmitter 7 and receiver 8 to measure a distance a≧S.

Figure 17:
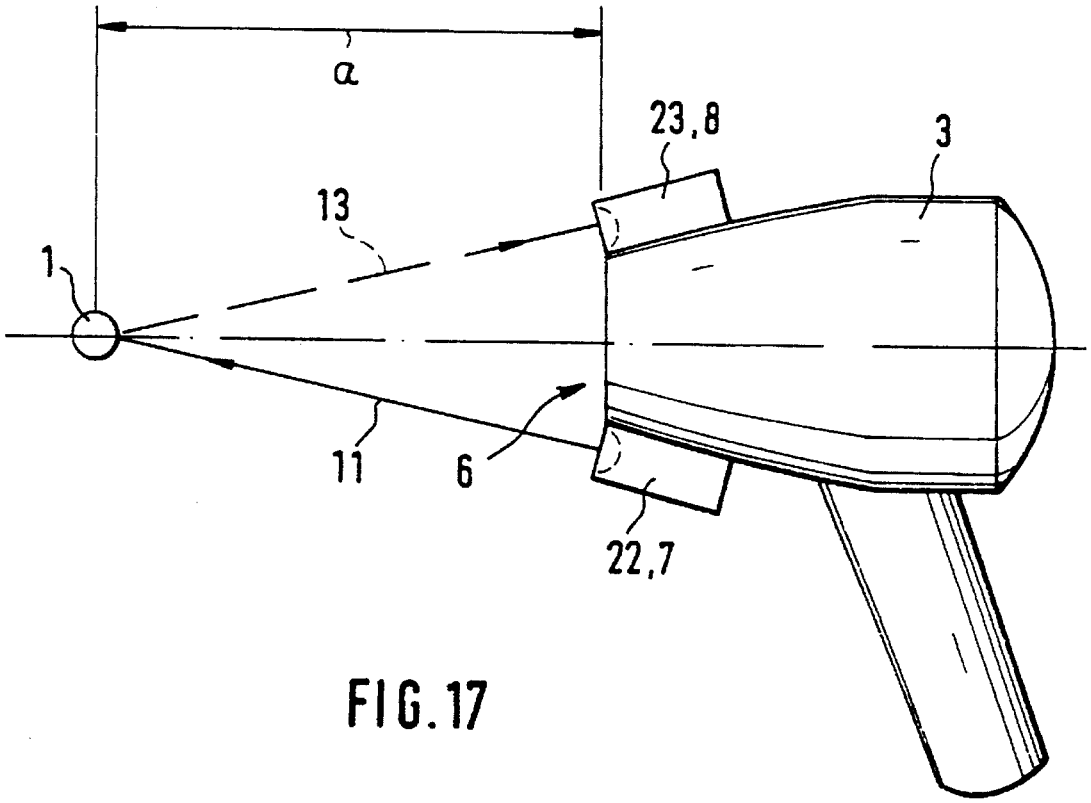
FIG. 17 is a diagrammatic side view of a hand-held device with a separate ultrasonic transmitter and receiver arranged adjacent to an air-flow outlet opening.

The device 3 according to FIG. 17 is provided with two separate ultrasonic transducers 22,23 for measuring distance a. One transducer 22 operates as an ultrasonic transmitter 7 and the other transducer 23 operates as an ultrasonic receiver 8. With the relatively large spatial separation of the transmitter 7 and receiver 8 which are arranged adjacent to the air flow outlet opening 6, short object distances, e.g., less than 100 mm, can also advantageously be detected. Further, very small objects 1 (thin strands of hair), can also be detected based on the general principles of ultrasound by adjusting a suitable receiver sensitivity and correspondingly masking the background.

Figure 18:
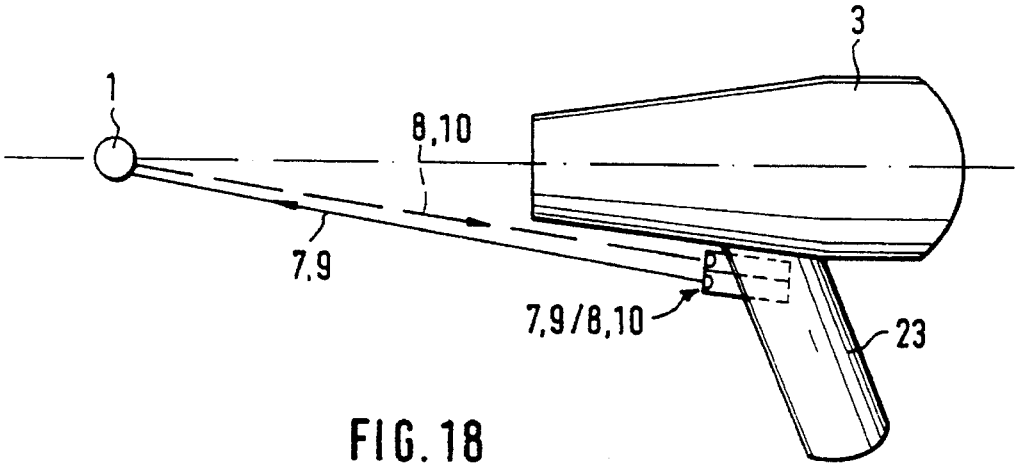
FIG. 18 is a diagrammatic side view of a hand-held device with a transmitter/receiver unit arranged in a handle.

In FIG. 18, the transmitter/receiver unit 7,9/8,10 is arranged in a handle 27 of the device 3.

Figure 19:
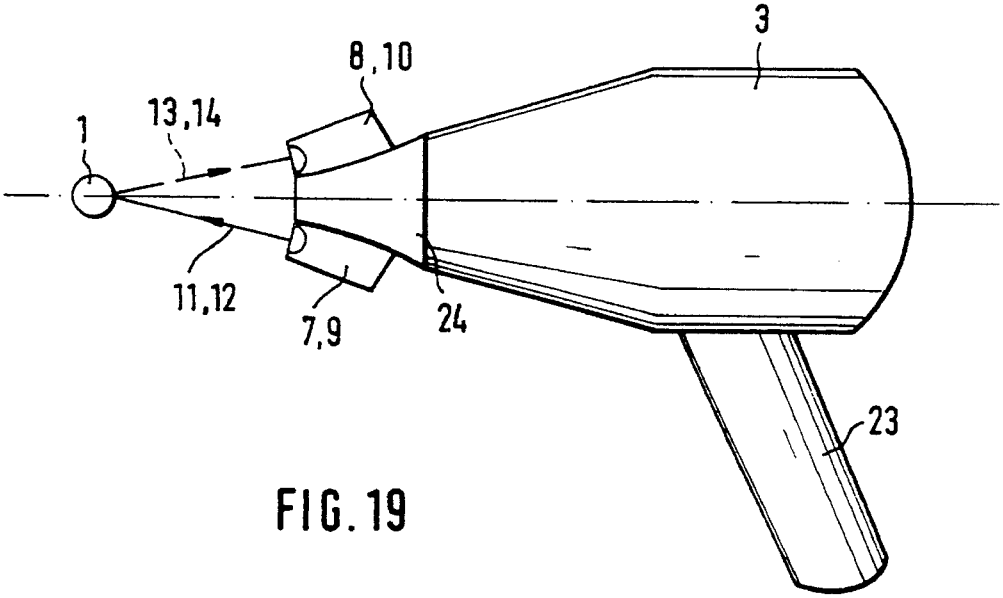
FIG. 19 is a diagrammatic side view of a hand-held device with a transmitter/receiver arranged on a hair waving nozzle.

In FIG. 19, a separate transmitter 7,9 and receiver 8,10 are arranged on a hair waving nozzle 24 of the device 3.

Figure 20:
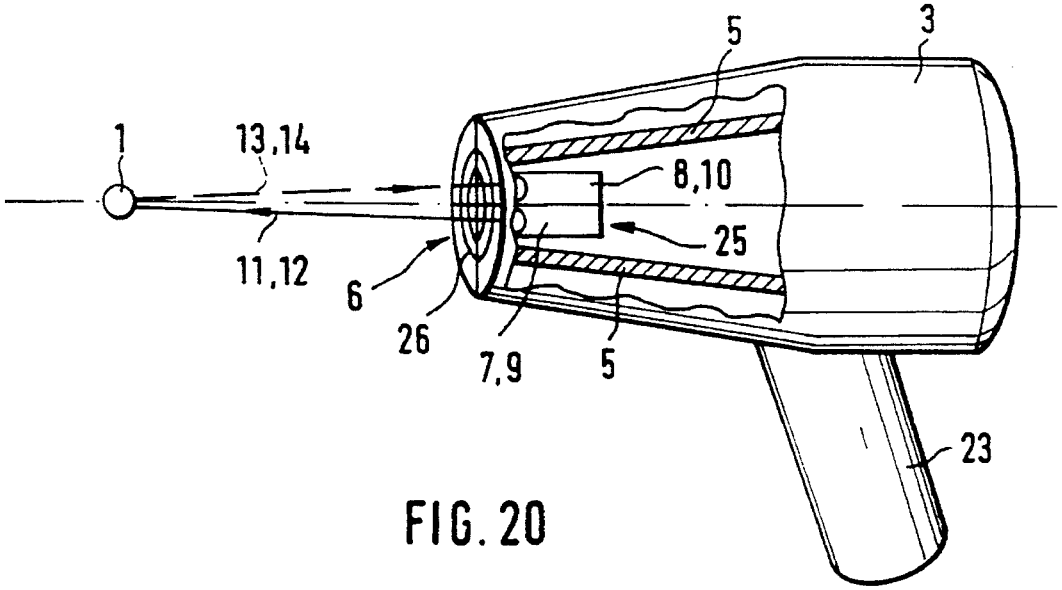
FIG. 20 is a diagrammatic side perspective view of a hand-held device with a transmitter/receiver unit arranged inside an air flow nozzle.

In the embodiment according to FIG. 20, the transmitter 7,9 and receiver 8,10 are arranged inside the device 3, e.g., in the cavity 25 of the heating device 5, without changing the outward appearance of the device 3. Foreground masking can be used to prevent measurements from being influenced by a protective grill 26 and the like.

Figure 21:
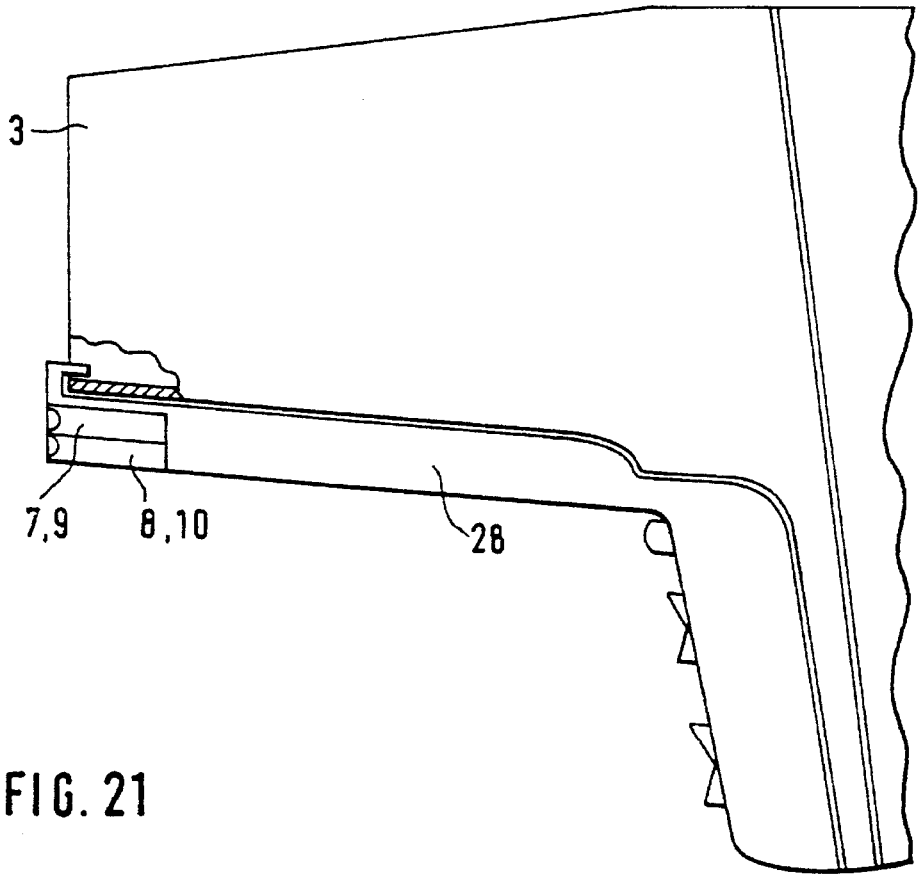
FIG. 21 is a diagrammatic side view of a transmitter/receiver unit which can be connected to a hand-held device.

In another embodiment according to FIG. 21, the device 3 can be retrofitted with a transmitter/receiver unit 7,9/8,10, e.g., by replacing a conventional handle 27 with a new handle 28 containing the transmitter/receiver unit 7,9/8,10 in a portion extending to the outlet 6.

Figure 22:
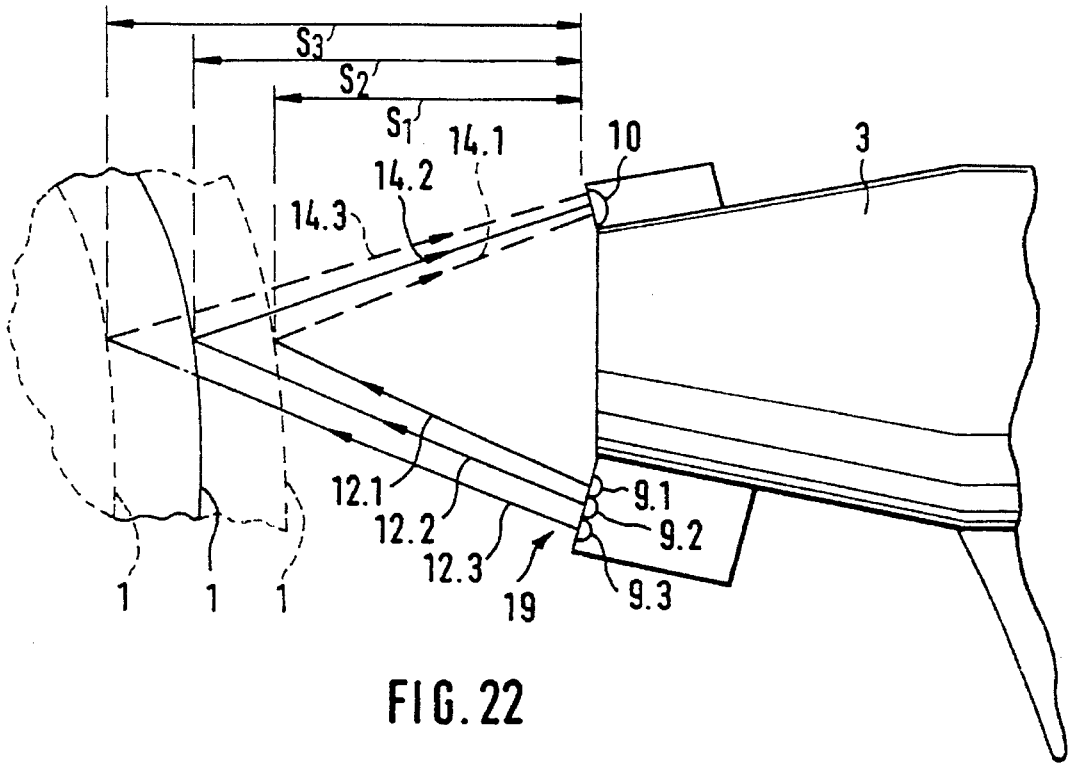
FIG. 22 is a diagrammatic side view of a hand-held device with a reflected light receiving device.

FIG. 22 shows a reflected light receiver 10 in the hand-held device 3. This receiver 10 receives light from a plurality of light transmitters 9.1,9.2,9.3. The distance between object 1 and air flow outlet opening 6 can be detected by modulating or encoding the light beams 14.1,14.2,14.3 in various ways within a determined range.

Figure 23:
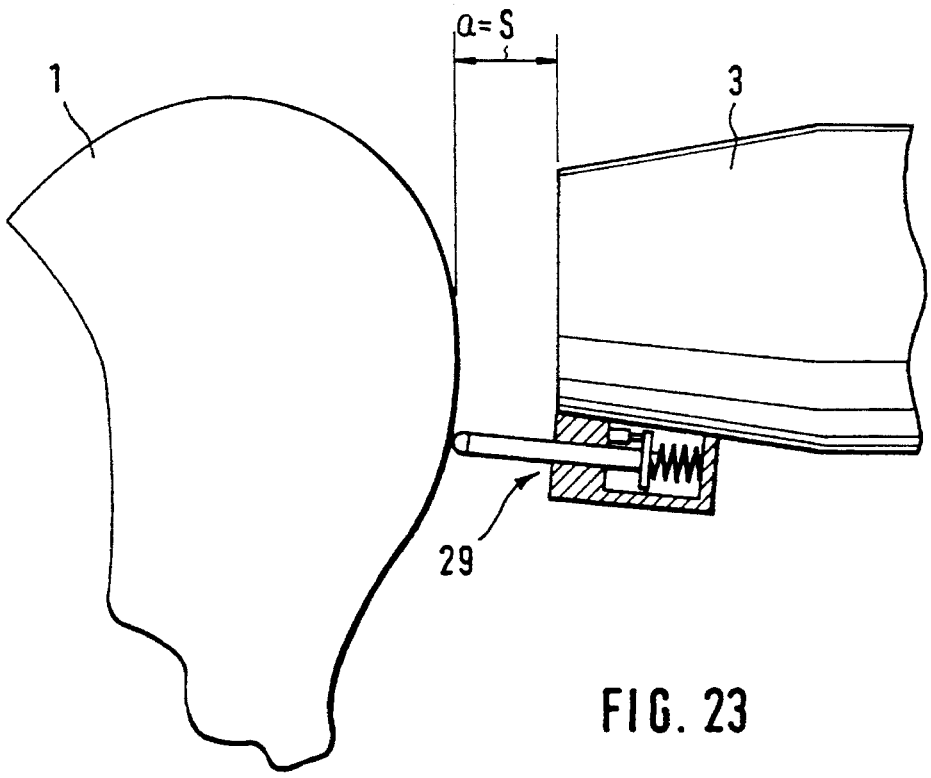
FIG. 23 is a diagrammatic side view of a hand-held device with a mechanical touch contact switch.

FIG. 23 shows the simplest embodiment in which a mechanical touch contact switch 29 is provided for monitoring the distance a to the object 1. The touch contact switch 29 turns off the heating device 5 when distance a exceeds its threshold value S.

Figure 24:
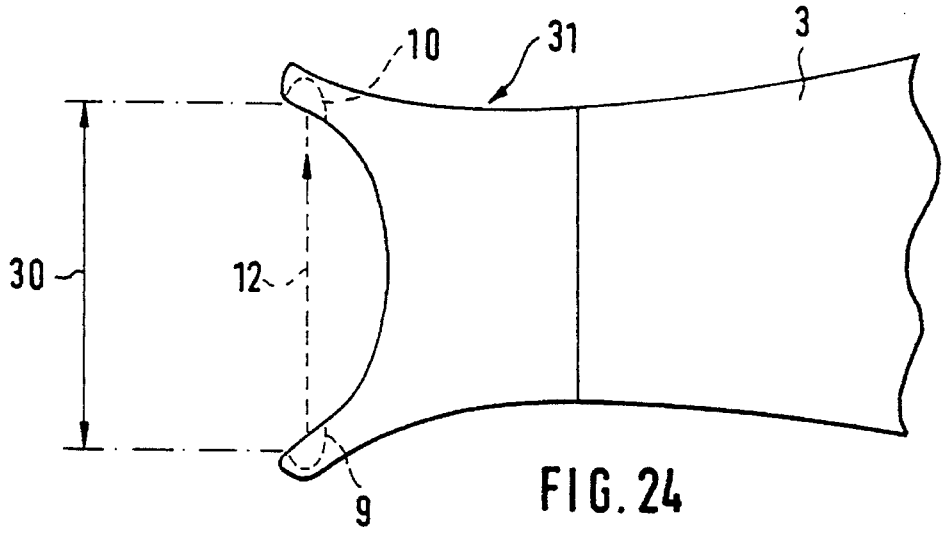
FIG. 24 is a plan view of a hand-held device with a light transmitting and receiving device.

FIG. 24 shows an embodiment with particularly reliable switching in which a beam path 30 is interrupted by the object 1, e.g., using a fork-like structure 31.

Figure 25:
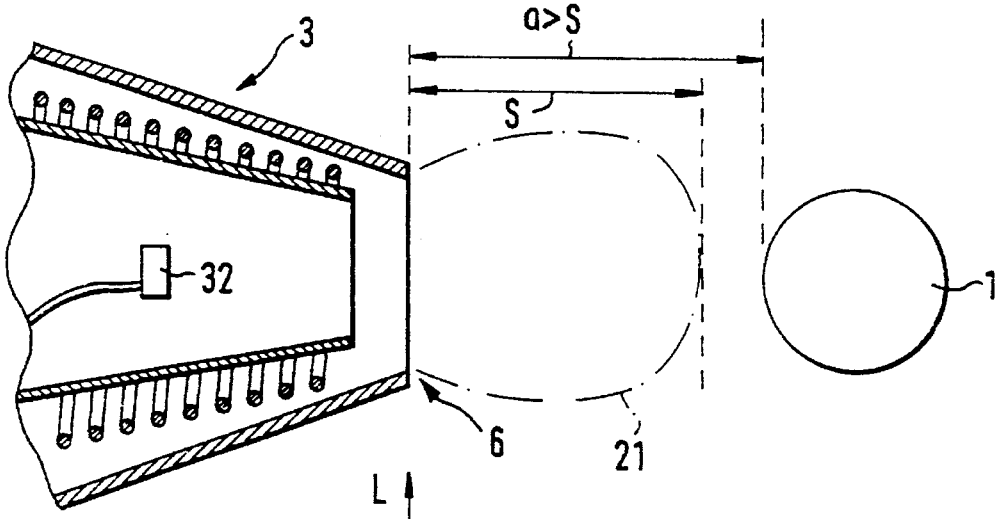
FIG. 25 is a diagrammatic cutaway cross-sectional view of an interior portion of a hand-held device according to the invention including an air pressure sensor arranged in the interior.

In another embodiment according to FIG. 25, an air pressure sensor 32 is arranged inside the device 3. This embodiment is based on the idea that an object 1 located in front of the air outlet opening 6 influences the air pressure ratios in the interior of the device 3, since the air flow pressure is increased or decreased relative to the unobstructed blowing state when a hot air flow 2 strikes an object 1.

Figure 26:
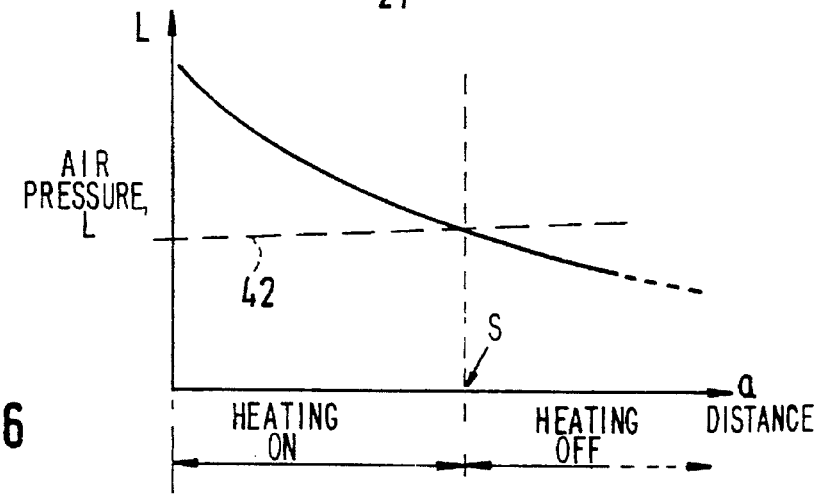
FIG. 26 is a graphical illustration of the dependence of air pressure on the distance of the device according to FIG. 25 from the object showing a switching threshold for the device of FIG. 25.

FIG. 26 shows a graphical illustration of the method of using the hand-held device 3 according to the embodiment in FIG. 25 in which the heating device 5 is switched on when the measured air flow pressure L reaches a predetermined switching threshold pressure 42 at switching point 43. In so doing, the switching point 43 can be adjusted in such a way that the corresponding air pressure L corresponds to the distance S and accordingly operates in a manner comparable to the method using the lobe-shaped ultrasonic field 21 according to FIG. 14.

In an additional embodiment of the invention according to FIGS. 27 and 28, the distance measuring device 19 (FIGS. 11, 22) is used to determine the distance a between an air flow outlet opening 6 and an object 1, or, more precisely, a portion of its surface, to regulate a heating output P for the purpose of maintaining a constant given air flow temperature on the object 1. The heating output P is regulated in proportion to the distance a of the object 1 from the outlet opening 6 located in the monitoring space 44 so that a constant temperature may be maintained within wide limits regardless of the distance a. As shown in FIG. 28 when the distance a is large, the heating output P is relatively high; when the distance a is small, the heating output P is relatively low (the heating output P changes approximately as a square function to the distance). The regulating curve 45 shown schematically in FIG. 28 maintains constant temperature at the object 1 as the distance a changes. Another regulating curve 46 illustrates a different method of operation which provides particularly stable hair styles without using a cold-air button. Accordingly, hair can be conditioned in a simple manner by slightly increasing the distance a. According to another regulating curve 47, the heating output P can be substantially reduced when the object 1 is located very close to the air flow output opening 6 and can be switched off entirely when there is no object 1 located in the monitoring space 44 (protection of hair).

Another embodiment of the device 3 and method of operation is shown in FIGS. 29 and 30. The regulating curve 48 of the heating output P shown in FIG. 30 is proportional to the size D of the object 1 located in the monitoring space 44. For example, the heating output P is increased when a large strand of hair is detected. All of the regulating curves 45 to 48 are to be adapted to the appropriate parameters of the particular embodiment of the hand-held device 3 in question.

It will be understood that each of the elements described above, or two or more together, may also find a useful application in other types of constructions differing from the types described above.

While the invention has been illustrated and described as embodied in a process for treating an object using a flow of hot air and a hand-held device for performing this process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Process for treating an object with a flow of hot air produced by a hand-held device, said hand-held device comprising a blower generating an air flow and a heating device for heating the air flow generated by the blower, said process comprising the steps of:

a) automatically at least reducing a heat output of the heating device from a predetermined heat output value when an interruption in the treating of the object with the hot air is occurring; and b) automatically restoring the heat output of the hand-held device to the predetermined heat output value when the interruption in the treating is not occurring; and c) determining that said interruption in said treating is occurring by detecting that a distance between the hand-held device and the object to be heated exceeds a threshold spacing (S).

2. Process as defined in claim 1, further comprising determining that said interruption in the treating is not occurring by detecting that the distance between the hand-held device and the object to be heated is reduced below the threshold spacing (S).

3. Process as defined in claim 1, wherein said automatically at least reducing the heat output of the heating device consists of turning off the heating device.

4. Process for treating an object with a flow of hot air produced by a hand-held device, said hand-held device comprising a blower generating an air flow and a heating device for heating the air flow generated by the blower, said process comprising the steps of:

a) automatically at least reducing a heat output of the heating device from a predetermined heat output value when an interruption in the treating of the object with the hot air is occurring;

b) automatically restoring the heat output of the hand-held device to the predetermined heat output value when the interruption in the treating is not occurring; and c) determining that said interruption in said treating is occurring by detecting that the flow of the hot air does not reach the object to be heated and that a distance between the hand-held device and the object to be heated exceeds a threshold spacing (S).

5. Process as defined in claim 4, further comprising determining that said interruption in the treating is not occurring by detecting that the flow of the hot air reaches the object to be heated and that the distance between the hand-held device and the object to be heated is reduced below the threshold spacing (S).

6. Process as defined in claim 4, wherein said automatically at least reducing the heat output of the heating device consists of turning off the heating device.

7. Hand-held device for treating an object with a flow of hot air comprising a blower for producing an air flow;

a heating device for heating the air flow from the blower to make a hot air flow;

means for automatically at least reducing a heat output of the heating device from a predetermined heat output value when an interruption in the treating of the object with the hot air is occurring;

means for automatically restoring the heat output of the hand-held device to the predetermined heat output value when the interruption in the treating is not occurring; and means for determining that said interruption in said treating is occurring including means for detecting that a distance between the hand-held device and the object to be heated exceeds a threshold spacing (S).

8. Hand-held device as defined in claim 7, further comprising means for determining that said interruption in the treating is not occurring including means for detecting that the distance between the hand-held device and the object to be heated is reduced below the threshold spacing (S).

9. Hand-held device as defined in claim 7, wherein the means for detecting that said distance between the hand-held device and the object exceeds the threshold spacing (S) comprises a sensor for measuring said distance.

10. Hand-held device as defined in claim 9, wherein said sensor comprises ultrasonic transmitter means for propagating an ultrasonic signal in a direction of the hot air flow from the blower and ultrasonic receiver means for receiving a reflected ultrasonic signal from said object.

11. Hand-held device as defined in claim 10, wherein said ultrasonic transmitter means and said ultrasonic receiver means comprise a single ultrasonic transducer operated alternately as an ultrasonic pulse transmitting device and an ultrasonic pulse receiving device and said single ultrasonic transducer is common to both said transmitter means and said receiver means.

12. Hand-held device as defined in claim 10, wherein said ultrasonic transmitter means comprises an ultrasonic transducer and said ultrasonic receiver means comprises another ultrasonic transducer different from said transducer used in said transmitter means.

13. Hand-held device as defined in claim 9, wherein said sensor for measuring said distance includes an air pressure sensor.

14. Hand-held device as defined in claim 9, further comprising a handle and a nozzle.

15. Hand-held device as defined in claim 14, wherein said sensor is mounted in said handle.

16. Hand-held device as defined in claim 14, wherein said sensor is mounted on said nozzle.

17. Hand-held device as defined in claim 14, having an interior and wherein said sensor is accommodated in said interior.

18. Hand-held device defined in claim 7, wherein said means for automatically at least reducing the heat output of the heating device includes means for turning off the heating device.

19. Hand-held device for treating an object with a flow of hot air comprising a blower for producing an air flow;

a heating device for heating the air flow from the blower to make a hot air flow;

means for automatically at least reducing a heat output of the heating device from a predetermined heat output value when an interruption in the treating of the object with the hot air is occurring;

means for automatically restoring the heat output of the hand-held device to the predetermined heat output value when the interruption in the treating is not occurring; and means for determining that said interruption in said treating is occurring including means for detecting that both the flow of the hot air does not reach the object to be heated and that a distance between the hand-held device and the object to be heated exceeds a threshold spacing (S).

20. Hand-held device as defined in claim 19, further comprising means for determining that said interruption in the treating is not occurring including means for detecting that the flow of the hot air reaches the object to be heated and that the distance between the hand-held device and the object to be heated is reduced below the threshold spacing (S).

21. Hand-held device as defined in claim 19, wherein said means for detecting that both the flow of the hot air does not reach the object to be heated and that a distance between the hand-held device and the object to be heated exceeds a threshold spacing (S) comprises an ultrasonic transmitter and ultrasonic receiver system for determining an absence of a hot air flow impinging on the object and measuring said distance between the hand-held device and the object.

22. Hand-held device as defined in claim 19, wherein said means for automatically at least reducing the heat output of the heating device includes means for turning off the heating device.

23. Hand-held device for treating an object with a flow of hot air comprising a blower for producing an air flow;

a heating device for heating the air flow from the blower to make a hot air flow;

means for automatically at least reducing a heat output of the heating device from a predetermined heat output value when an interruption in the treating of the object with the hot air is occurring; and means for automatically restoring the heat output of the hand-held device to the predetermined heat output value when the interruption in the treating is not occurring; wherein said means for automatically at least reducing the heat output includes means for lowering an air temperature of the hot air flow on the object in proportion to a distance (a) from the object.

24. Hand-held device as defined in claim 23, wherein said means for automatically at least reducing the heat output of the heating device includes means for turning off the heating device.

25. Hand-held device for treating an object with a flow of hot air comprising a blower for producing an air flow;

a heating device for heating the air flow from the blower to make a hot air flow;

means for automatically at least reducing a heat output of the heating device from a predetermined heat output value when an interruption in the treating of the object with the hot air is occurring; and means for automatically restoring the heat output of the hand-held device to the predetermined heat output value when the interruption in the treating is not occurring; and means for controlling the heat output so that said heat output is proportional to a size of the object.

26. Hand-held device as defined in claim 25, wherein said means for automatically at least reducing the heat output of the heating device includes means for turning off the heating device.

* * * * *